United States Patent [19]

Cremeen

[11] 4,422,078

[45] Dec. 20, 1983

[54] FULL WAVE COMMUNICATION ANTENNA

[76] Inventor: Melvin L. Cremeen, 643 Edgewater NW., Space F-1, Salem, Oreg. 97304

[21] Appl. No.: 412,177

[22] Filed: Aug. 27, 1982

Related U.S. Application Data

[63] Continuation of Ser. No. 210,127, Nov. 24, 1980.

[51] Int. Cl.[3] ..... H01Q 1/36

[52] U.S. Cl. ..... 343/895; 343/749

[58] Field of Search ..... 343/749, 750, 895, 711, 343/713

[56] References Cited

U.S. PATENT DOCUMENTS 4,101,898 7/1978 Ingram ..... 343/752

4,161,737 7/1979 Albright ..... 343/895

*Primary Examiner*—David K. Moore

*Attorney, Agent, or Firm*—Oliver D. Olson

[57] ABSTRACT

A rod of dielectric material of uniform diameter of about 9.5 mm and about 1.2 meters in length supports about 8.4 meters of insulated copper wire of about 1.6 mm diameter coiled about the rod to form adjacent one end a base coil of at least three tight turns and at the opposite end five tight loading coils each about 5.5 centimeters in length and spaced apart from each other about 6.4 mm. A tight trim coil is spaced about 6.4 mm from the outermost one of the loading coils and contains a number of turns 6.4 mm from the outermost one of the loading coils and it contains a number of turns selected to optimize the standing wave ratio of the adjacent coils. The length of wire between the base coil and innermost one of the loading coils is coiled about the rod in single wide turns to minimize radiation therefrom. Shrink tubing overlies and conceals the wire. The base coil end of the rod is secured to a mounting support from which the rod extends vertically upward, and the free end of the base coil wire is arranged for connection to an 11 meter citizens band transreceiver.

4 Claims, 6 Drawing Figures

FULL WAVE COMMUNICATION ANTENNA

This application is a continuation of application Ser. No. 210,127, filed Nov. 24, 1980.

BACKGROUND OF THE INVENTION

This invention relates to radio antennas, and more particularly to a highly efficient citizens band antenna.

Citizens band antennas presently available in the marketplace are of the quarter or half wave type capable of transmission and reception over no more than about ten kilometers.

Some of these incorporate specific arrangements of antenna wire windings in order to reduce the overall length of the antenna and thereby accommodate use on mobile equipment. Typical of these are structures disclosed in U.S. Pat. Nos. 3,259,901; 3,774,221; 4,097,867; 4,161,737; and 4,163,981.

SUMMARY OF THE INVENTION

In its basic concept, this invention provides a full wave antenna having a radiating base coil at the bottom end of a supporting dielectric rod and a plurality of radiating loading coils at the top end of the rod, the base and loading coils being interconnected by a length of wire arranged to provide minimum radiation.

It is by virtue of the foregoing basic concept that the principal objective of this invention is achieved; namely, to provide a communication antenna by which the distances of transmission and reception are increased by several magnitudes over conventional quarter and half-wave communication antennas.

Another object of this invention is the provision of a full wave antenna of the class described which is usable on mobile ground vehicles and boats as well as fixed buildings and at diverse frequencies.

A further object of this invention is to provide a full wave antenna of the class described which operates substantially free of radio static.

A still further object of this invention is to provide a full wave antenna of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 1:
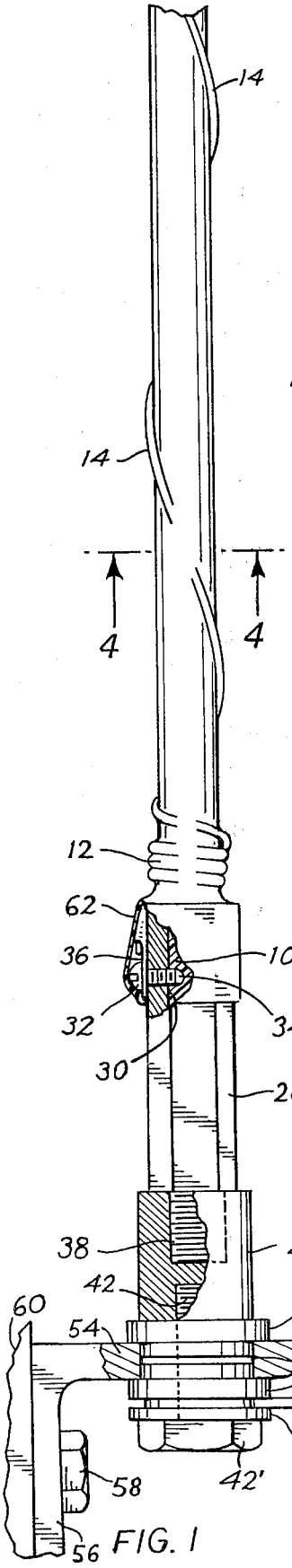
FIG. 1 is a fragmentary vertical elevation of the bottom portion of an antenna embodying the features of this invention, parts being broken away to disclose internal structural details.

The antenna of this invention utilizes a rod 10 of electrically non-conductive, or dielectric material, such as fiberglass or other suitable synthetic resin, as an elongated support for the antenna wire. The rod may be hollow or solid in cross section and it is of uniform diameter throughout its length.

For the specific purpose of a citizens band transceiver antenna the rod is about 1 to 2 meters, preferably about 1.2 meters in length and about 9 to 10 mm. preferably about 9.5 mm in diameter, for supporting about 8.4 meters of insulated copper wire of about 1.4 to 1.8 mm, preferably about 1.6 mm diameter. For use on mobile vehicles, greater rod lengths render it difficult for such vehicles to pass through garage door openings and other areas of limited vertical height.

For the present citizens band frequency range, 8.4 meters of insulated copper wire of about 1.6 mm in diameter coiled about the rod in the manner to be described, provides a transmitting and receiving antenna having an electrical length of about 11 meters. It has found that the antenna of this invention is effective not only for the original 40 citizens band channels but also for the 40 additional side band channels recently allocated.

Adjacent the bottom end of the rod, i.e. the end which is to be secured to a mounting support described hereinafter, the antenna wire is coiled about the rod to form a radiating base coil 12 of at least three tight turns. It is preferred that there be 5 to 7 such turns; additional turns are merely wasteful of wire length and do not contribute to any further improvement in antenna performance.

From the base coil a substantially non-radiating section of the antenna wire is extended along a substantial length of the rod in wide single turns 14, or in such other arrangement as will produce minimum radiation from that length of wire. In the embodiment illustrated, assuming a 1.2 meter length of rod, the single turns shown each extends for about 10 cm and they total about 75 cm in length.

Figure 2:
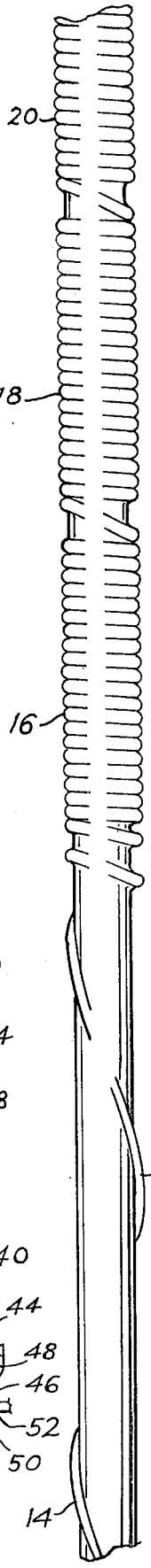
FIG. 2 is a fragmentary vertical elevation of a middle portion of the antenna of FIG. 1, FIG. 2 being an extension of FIG. 1.

At the upper end of the single wire turns 14 (FIG. 2) the wire is wrapped about the rod to form five radiating loading coils 16, 18, 20, 22 and 24 each formed of a plurality of tight wire turns and each measuring 5 to 6 centimeters in length, preferably about 5.5 centimeters. The five loading coils are spaced apart from each other a distance of about 3 to 9 mm, preferably about 6 mm, whereby each loading coil produces its own radiation pattern.

Adjacent the outermost loading coil 24, the remaining length of antenna wire is wrapped about the rod in a multiplicity of tight coil turns to provide a radiating trim coil 26. This trim coil is spaced from the outermost loading coil by the same distance as the spacing between adjacent loading coils, and the number of turns of the trim coil is selected to optimize the standing wave ratio of the loading coils, as checked by a standing wave meter.

The bottom end of the rod, i.e. the end adjacent the base coil 12, is secured to an electrically conductive base 28 (FIG. 1). As illustrated, the end of the rod is extended into a socket 30 formed in the upper end of the base, and is secured therein by means of a set screw 32 which extends through a threaded opening in the base and projects into a registering socket 34 in the rod. The set screw also serves to secure the bottom end of the antenna wire which extends from the base coil 12 and is fitted with a terminal eyelet connector 36 through which the set screw extends. The antenna wire thus is connected electrically to the metal base 28.

The opposite, bottom end of the metal base is provided with an externally threaded section 38 removably connected to the internally threaded socket in one end of a metal coupler 40. The opposite end of the coupler also is provided with an internally threaded socket arranged to removably receive the threaded shank 42 of a connecting bolt. This threaded shank extends through a pair of annular electric insulators 44 and 46 which extend into an opening 48 in a metal mounting bracket, from opposite sides of the opening. Interposed between the bottom insulator 46 and the bolt head 42' is a washer 50 and the eyelet connector 52 of an electrical conductor cable, by which the antenna wire is connected to a remotely located transmitter, receiver, or conventional citizens band transceiver.

As illustrated, the metal mounting bracket is L-shaped. The mounting opening 48 for the antenna assembly is provided in the horizontal section 54 of the bracket, while the vertical section 56 of the bracket is apertured for the reception of one or more bolts 58 by which the bracket is secured to a vehicle, boat, building, or other supporting structure 60.

Various means may be provided for securing the coils of antenna wire against displacement on the rod 10 and also to protect the wire from damage and the coils from displacement. Such means may be an adhesive applied to the rod prior to the wrapping of the wire. It may also be adhesive tape wrapped in spiral manner over the wire substantially the full length of the rod. In the preferred embodiment illustrated, a shrink tubing 62 of flexible synthetic plastic is slipped over the wrappings on the rod, and preferably over the adjacent end portion of the metal base 28 (FIG. 1) and then is heated in conventional manner to cause it to shrink tightly about the wrappings and rod. A protective weather sealing cap 64 is stretched over the top end of the rod and adjacent portion of the shrink tubing to provide a weather seal.

Figure 6:
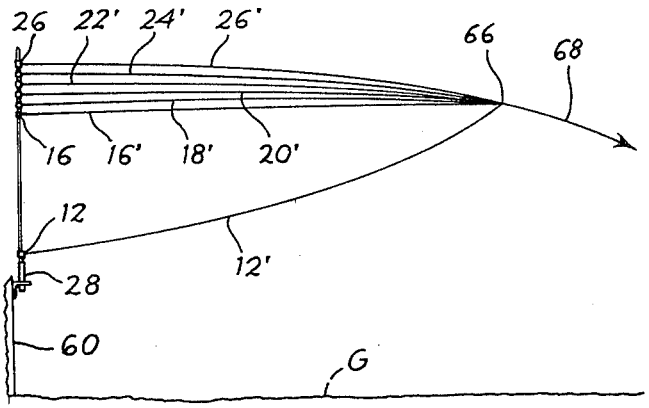
FIG. 6 is a diagrammatic representation of the radiation pattern of the antenna of the preceding views.
Figure 3:
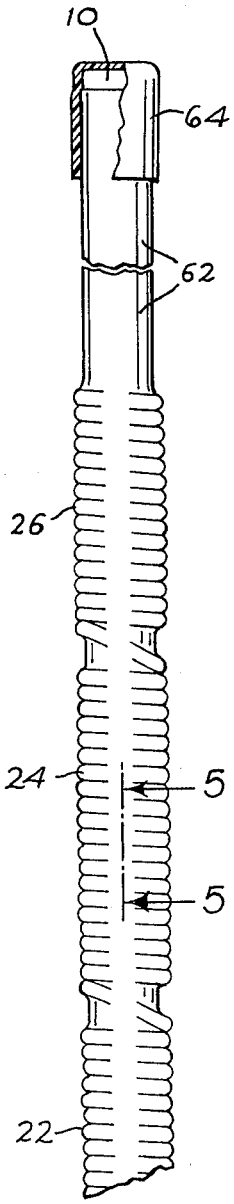
FIG. 3 is a fragmentary, foreshortened vertical elevation of the top portion of the antenna of FIG. 1, FIG. 3 being an extension of FIG. 2.
Figure 4:
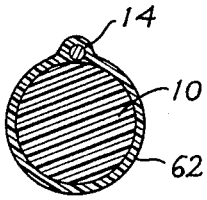
FIG. 4 is a transverse section, on an enlarged scale, taken on the line 4—4 in FIG. 1.
Figure 5:
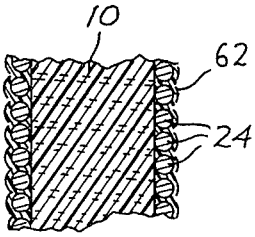
FIG. 5 is a fragmentary longitudinal section, on an enlarged scale, taken on the line 5—5 in FIG. 3.

The importance of the base coil 12 and the five loading coils 16–24 separated therefrom by a length of wide single coil turns 14, has been determined by performance of the antenna and measurements made thereon. By means of field strength meter readings, it has been determined that the base coil produces a vertical radiation field pattern 12' (FIG. 6) which projects from the coil angularly upward for a distance of about three meters where it merges with the vertical radiation field patterns 16', 18', 20', 22', 24' of the loading coils. The radiation pattern of the lowermost loading coil 16 extends substantially horizontally from the coil, while the radiation patterns of the next succeeding coils, including the pattern 26' of the trim coil 26, extend angularly downward where they merge with the radiation pattern of the basecoil. At this point of mergence 66 of these vertical radiation field patterns, the pattern 68 becomes horizontal and continues outward and angularly downward to the ground G.

Field tests of the antenna described hereinbefore have established that the ranges of transmission and reception are increased by several magnitudes over conventional citizens band transceiver antennas of the quarter wave or half wave type. To illustrate, a conventional citizens band transceiver antenna was mounted on a vehicle and connected to a conventional CB transceiver in the vehicle. The vehicle then was driven in a selected direction away from a CB base station, until reception was lost at about 10 kilometers. At that point the signal to noise ratio was measured at about 7 to 9 dB. The antenna of this invention, as described hereinbefore, then was installed in place of the conventional antenna and the vehicle driven in the same direction until reception was lost at about 56 kilometers. The signal to noise ratio remained the same as above.

In a further test, the same CB transceiver and the antenna of this invention achieved reception of conventional CB transmission from a distance of about 240 kilometers over substantially level terrain.

Experiments have established the importance of certain of the physical parameters discussed hereinbefore for the eleven meter band. Thus, the dielectric rod must be at least about 1 meter in length in order for the specific coils to be wrapped upon it. The antenna wire must be substantially 1.6 mm in diameter and the rod about 9.5 mm in diameter in order for the 8.4 meters of copper wire to be wound in the prescribed manner forming the base coil and the five loading coils, together with the trim coil, all of which are required in order to achieve the increased distance of substantially noise free transmission and reception from conventional citizens band transceivers.

It has been found that the antenna configuration of this invention may be utilized for the ten meter amateur band merely by shortening the trim coil 26 to reduce the radiation frequency to the ten meter band and set the optimum standing wave ratio. This use is accommodated by the fact that the antenna is capable of operating between 1 and 2000 watts. For all applications, the basic design of this antenna is characterized by a dB gain of about 4 to 6 over a conventional base loaded quarter wave antenna.

Having now described my invention and the manner in which it may be used, I claim:

1. A full wave communication antenna for use with communication equipment, comprising:

(a) an elongated antenna rod of dielectric material of substantially uniform diameter and defining the top and bottom ends of a vertical antenna, and (b) an antenna wire of length corresponding to a selected radiation frequency, wrapped about the rod to provide (1) a radiating base coil adjacent the bottom end of the rod, the bottom end of the base coil wire being arranged for connection to communication equipment, (2) a substantially non-radiating antenna wire section extending along the rod from the top end of the base coil toward the top end of the rod a length greater than one-half the length of the rod, and (3) a plurality of longitudinally closely spaced radiating loading coils of substantially equal numbers of a plurality of coil turns extending along the rod from the non-radiating wire section toward the top end of the rod, (4) the base and loading coils being configured to produce vertical radiation field patterns at substantially the selected radiation frequency and which field patterns merge together a distance radially outward of the rod and there change to a horizontal field pattern which proceeds downward to the ground.

2. The full wave communication antenna of claim 1 including a radiating trim coil adjacent and spaced from the topmost loading coil and having a sufficient number of turns to provide the radiating loading coils with a predetermined standing wave ratio.

3. The full wave communication antenna of claim 1 wherein the rod is about 9 to 10 mm in diameter, the antenna wire is copper having a length of about 8.4 meters and a diameter of about 1.4 to 1.8 mm, the base coil includes at least three tight turns of the antenna wire, each loading coil comprises a plurality of tight turns of the antenna wire extending along the rod for about 5 to 6 centimeters, the loading coils are five in number and spaced apart about 3 to 9 mm, and the non-radiating wire section comprises a plurality of wide single turns of the antenna wire extending about 75 centimeters along the rod.

4. The full wave communication antenna of claim 1 wherein the rod is about 9.5 mm in diameter, the antenna wire is copper having a length of about 8.4 meters and a diameter of about 1.6 mm, the base coil includes 3 to 7 tight turns of the antenna wire, each loading coil comprises a plurality of tight turns of the antenna wire extending along the rod for about 5.4 centimeters, the loading coils are five in number and spaced apart about 6 mm, and the non-radiating wire section comprises a plurality of wide single turns of the antenna wire extending about 75 centimeters along the rod.

* * * * *